US010876493B2

(12) United States Patent
Tada

(10) Patent No.: US 10,876,493 B2
(45) Date of Patent: Dec. 29, 2020

(54) INTERNAL COMBUSTION ENGINE

(71) Applicant: TOYOTA JIDOSHA KABUSHIKI KAISHA, Toyota (JP)

(72) Inventor: Hiroshi Tada, Mishima (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/506,000

(22) Filed: Jul. 9, 2019

(65) Prior Publication Data

US 2020/0072157 A1 Mar. 5, 2020

(30) Foreign Application Priority Data

Sep. 4, 2018 (JP) ..... 2018-165477

(51) Int. Cl.
*F02F 1/14* (2006.01)
*F01P 3/02* (2006.01)
*F02F 1/10* (2006.01)

(52) U.S. Cl.
CPC *F02F 1/14* (2013.01); *F01P 3/02* (2013.01); *F01P 2003/021* (2013.01); *F02F 2001/104* (2013.01)

(58) Field of Classification Search
CPC ..... F02F 1/14; F01P 3/02; F01P 2003/021
See application file for complete search history.

(56) References Cited

U.S. PATENT DOCUMENTS 9,803,534 B2 * 10/2017 Marutani ..... F01P 3/02
2009/0031978 A1 * 2/2009 Kobayashi ..... F01P 11/20 123/142.5 R
2011/0114042 A1 * 5/2011 Hamakawa ..... F02F 1/14 123/41.72

FOREIGN PATENT DOCUMENTS

EP 1930564 A * 6/2008
EP 1930564 A1 6/2008
JP 2008-128133 A 6/2008
JP 2015-108345 A 6/2015
JP 2015-108346 A 6/2015

* cited by examiner

*Primary Examiner* — Kevin A Lathers
(74) *Attorney, Agent, or Firm* — Oliff PLC

(57) ABSTRACT

A cylinder structure includes cylinders arranged inline. A cooling channel facing a first side wall of the cylinder structure includes a first inner channel and a first outer channel. The first inner channel is arranged for a first cooling medium to flow through. The first outer channel is away from the first side wall than the first inner channel is, and arranged for a second cooling medium to flow through. A cooling channel facing a second side wall of the cylinder structure includes a second outer channel and a second inner channel. An upstream part of the second outer channel is connected to a downstream part of the first outer channel. The second inner channel is close to the second side wall than the second outer channel is. Connection channels connecting between the second outer channel and the second inner channel are respectively provided at positions facing the cylinders.

6 Claims, 10 Drawing Sheets

INTERNAL COMBUSTION ENGINE

BACKGROUND

Technical Field

The present disclosure relates to an internal combustion engine including a cooling channel for cooling a plurality of cylinders.

Background Art

Patent Literature 1 discloses a configuration of a water jacket of an internal combustion engine. Cooling water in the water jacket flows along a plurality of cylinders in turn. An upstream part of the water jacket is separated into an upper channel and a lower channel. Upper cooling water flowing through the upper channel cools an outer wall of the plurality of cylinders directly. Whereas, lower cooling water flowing through the lower channel is not in contact with the outer wall of the plurality of cylinders. Therefore, a rise in temperature of the lower cooling water is suppressed. The lower cooling water is guided by an upward guiding member to the upper channel to join the upper cooling water. As a result, the plurality of cylinders are sufficiently cooled also in a downstream part of the water jacket.

LIST OF RELATED ART

Patent Literature 1: Japanese Unexamined Patent Application Publication No. JP-2008-128133

SUMMARY

According to the technique disclosed in the above-mentioned Patent Literature 1, a temperature of the cooling water in the water jacket (cooling channel) rises from the upstream part towards the downstream part. That is, cooling performance decreases from the upstream part towards the downstream part. Although the cooling performance temporarily recovers due to the lower cooling water joining the upper cooling water, thereafter the cooling performance decreases again towards the downstream part. Since the cooling performance decreases towards the downstream part, a cooling effect on the plurality of cylinders becomes non-uniform. This causes variation in temperature between the plurality of cylinders, which is not preferable.

An object of the present disclosure is to provide a technique that is related to an internal combustion engine including a cooling channel for cooling a plurality of cylinders and can cool the plurality of cylinders more uniformly.

A first aspect provides an internal combustion engine.

The internal combustion engine includes:

a cylinder structure including a plurality of cylinders arranged inline; and a cooling channel arranged around a side wall of the cylinder structure, and through which a cooling medium flows.

The side wall of the cylinder structure includes:

a first side wall on one of an intake side and an exhaust side; and a second side wall on another of the intake side and the exhaust side.

The cooling channel includes:

an inlet to which the cooling medium is injected;

a first inner channel facing the first side wall, whose upstream part being connected to the inlet, and arranged for a first cooling medium of the injected cooling medium to flow through;

a first outer channel facing the first side wall, being away from the first side wall than the first inner channel is, whose upstream part being connected to the inlet, and arranged for a second cooling medium of the injected cooling medium to flow through;

a second outer channel facing the second side wall, whose upstream part being connected to a downstream part of the first outer channel, and arranged for the second cooling medium to flow through;

a second inner channel facing the second side wall, and being close to the second side wall than the second outer channel is; and a plurality of connection channels connecting between the second outer channel and the second inner channel, and respectively provided at positions facing the plurality of cylinders.

A second aspect further has the following feature in addition to the first aspect.

Cross-sectional areas of the plurality of connection channels increase from the upstream part towards a downstream part of the second outer channel.

A third aspect further has the following feature in addition to the first or second aspect.

The cylinder structure and the cooling channel are arranged in a cylinder block.

The first inner channel is arranged for the first cooling medium to be drained out of the cylinder block without joining the second cooling medium.

A fourth aspect further has the following feature in addition to any one of the first to third aspects.

A cross-sectional area of the first inner channel decreases from the upstream part towards a downstream part of the first inner channel.

A fifth aspect further has the following feature in addition to any one of the first to fourth aspects.

The cooling channel further comprises an inter-cylinder channel arranged between adjacent cylinders of the plurality of cylinders.

The inter-cylinder channel is connected to the second outer channel.

According to the first aspect, the cooling channel facing the first side wall of the cylinder structure includes the first inner channel and the first outer channel. The cylinder structure on the side of the first side wall is effectively cooled by the first cooling medium flowing through the first inner channel. Meanwhile, cooling performance of the second cooling medium flowing through the first outer channel is maintained without deterioration, because the first outer channel is away from the first side wall than the first inner channel is.

The cooling channel facing the second side wall of the cylinder structure includes the second inner channel and the second outer channel. The upstream part of the second outer channel is connected to the downstream part of the first outer channel. Accordingly, the second cooling medium with high cooling performance flows from the first outer channel into the second outer channel. Moreover, the second outer channel is away from the second side wall than the second inner channel is. Therefore, the high cooling performance of the second cooling medium is maintained also in the second outer channel.

The connection channel connects between the second inner channel and the second outer channel. The second cooling medium in the second outer channel is supplied to the second inner channel through the connection channel. The cylinder structure on the side of the second side wall also is effectively cooled by the second cooling medium with the high cooling performance.

Furthermore, the plurality of connection channels are respectively provided at positions facing the plurality of cylinders of the cylinder structure. Therefore, the second cooling medium is supplied in parallel through the plurality of connection channels to the second inner channel at the positions facing the plurality of cylinders, respectively. It is thus possible to cool the plurality of cylinders more uniformly, as compared with a case where the second cooling medium flows along the plurality of cylinders in turn through the second inner channel. As a result, variation in temperature between the plurality of cylinders is suppressed.

According to the second aspect, the cross-sectional areas of the plurality of connection channels increase from the upstream part towards the downstream part of the second outer channel. Meanwhile, a pressure of the second cooling medium in the second outer channel decreases from the upstream part towards the downstream part. Therefore, respective flow rates of the second cooling media passing through the plurality of connection channels are equalized, and it is thus possible to further uniformly cool the plurality of cylinders.

According to the third aspect, the first inner channel is arranged for the first cooling medium to be drained out of the cylinder block without joining the second cooling medium. Since the first cooling medium whose cooling performance is lowered does not join the second cooling medium, decrease in cooling performance of the second cooling medium is suppressed.

According to the fourth aspect, the cross-sectional area of the first inner channel decreases from the upstream part towards the downstream part of the first inner channel. Therefore, a flow speed of the first cooling medium increases from the upstream part towards the downstream part of the first inner channel. Meanwhile, a temperature of the first cooling medium rises from the upstream part towards the downstream part of the first inner channel. Increase in cooling performance due to the increase in flow speed compensates the decrease in cooling performance due to the rise in temperature. It is thus possible to more uniformly cool the plurality of cylinders also on the side of the first side wall.

According to the fifth aspect, the inter-cylinder channel arranged between the adjacent cylinders is connected to the second outer channel. As a result, the second cooling medium with the high cooling performance is supplied from the second outer channel to the inter-cylinder channel. A part between the adjacent cylinders is effectively cooled by the second cooling medium with the high cooling performance.

EMBODIMENTS

Embodiments of the present disclosure will be described below with reference to the attached drawings.

1. First Embodiment

1-1. Schematic Configuration

Figure 1:
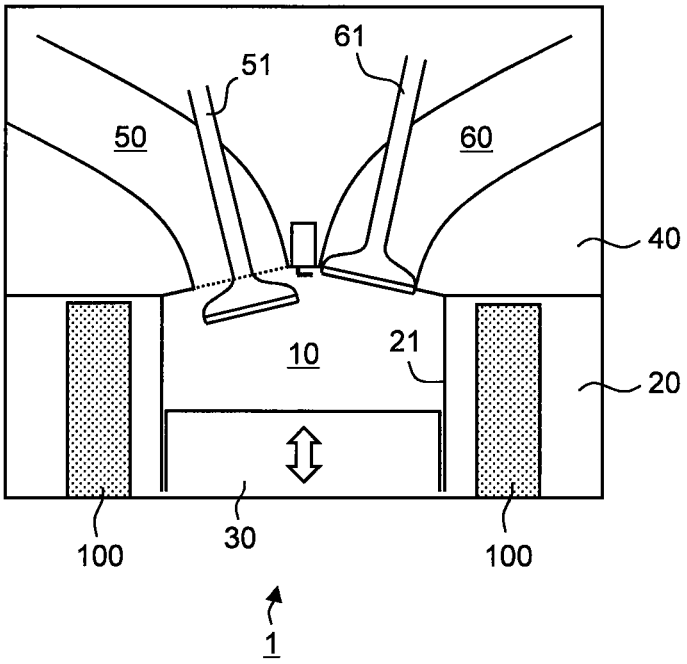
FIG. 1 is a schematic diagram showing a configuration of an internal combustion engine according to a first embodiment of the present disclosure.

FIG. 1 is a schematic diagram showing a configuration of an internal combustion engine 1 according to a first embodiment. The internal combustion engine 1 includes a cylinder 10 and a cooling channel 100 for cooling the cylinder 10.

The cylinder 10 (a combustion chamber) is formed in a cylinder block 20. More specifically, a cylinder liner 21 (a cylinder bore) having a cylindrical shape forms an inner side surface of the cylinder 10. A piston 30 is provided so as to reciprocate in an axis direction of the cylinder 10. An upper surface of the piston 30 forms a bottom surface of the cylinder 10. A cylinder head 40 is placed on the cylinder block 20. A bottom surface of the cylinder head 40 forms an upper surface of the cylinder 10.

An intake port 50 is provided for supplying intake gas to the cylinder 10. An exhaust port 60 is provided for exhausting exhaust gas from the cylinder 10. The intake port 50 and the exhaust port 60 are formed within the cylinder head 40. An intake valve 51 is provided at an opening of the intake port 50 to the cylinder 10. An exhaust valve 61 is provided at an opening of the exhaust port 60 to the cylinder 10.

Figure 2:
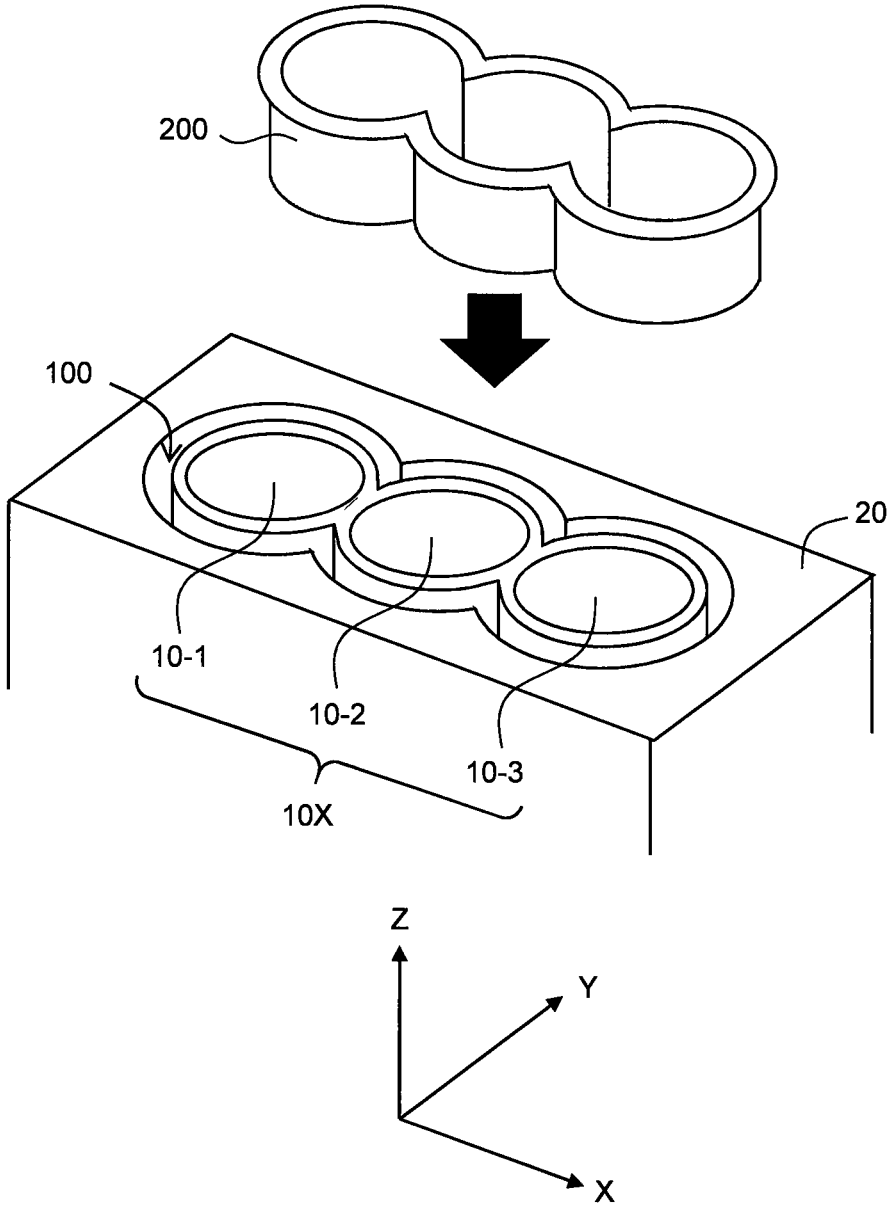
FIG. 2 is a schematic diagram for explaining a cylinder structure and a cooling channel according to the first embodiment of the present disclosure.

The cooling channel 100 (a water jacket) is formed around the cylinder 10 in the cylinder block 20. A cooling medium (e.g. cooling water) flows through the cooling channel 100, thereby cooling the cylinder 10, FIG. 2 is a schematic diagram for explaining a cylinder structure 10X and the cooling channel 100 according to the present embodiment. The cylinder structure 10X is a collection of a plurality of cylinders 10-*i* (i is an integer equal to or larger than 2). In the example shown in FIG. 2, the cylinder structure 10X includes a plurality of cylinders 10-1 to 10-3. The plurality of cylinders 10-*i* are arranged inline in one direction.

In the description below, an X-direction is the one direction in which the plurality of cylinders 10-*i* are arranged. A Z-direction is a direction of movement of the piston 30. The X-direction is orthogonal to the Z-direction. A Y-direction is a direction orthogonal to the X-direction and the Z-direction. An upward direction is a direction of ascension of the piston 30, that is, a direction from the cylinder block 20 towards the cylinder head 40. A downward direction is a direction opposite to the upward direction.

A shown in FIG. 2, the cylinder structure 10X and the cooling channel 100 are arranged in the cylinder block 20. The cooling channel 100 is arranged around a side wall of the cylinder structure 10X. The cylinder structure 10X (i.e. the plurality of cylinders 10-*i*) is cooled by the cooling medium flowing through the cooling channel 100.

A configuration (structure) of the cooling channel 100 is adjustable by the use of a water jacket spacer 200 as shown in FIG. 2. More specifically, when assembling the internal combustion engine 1, the water jacket spacer 200 is inserted into the cooling channel 100. As a result, the cooling channel 100 with a desired configuration is obtained.

Hereinafter, a configuration of the cooling channel 100 according to the present embodiment will be described in detail.

1-2. Configuration of Cooling Channel

Figure 3:
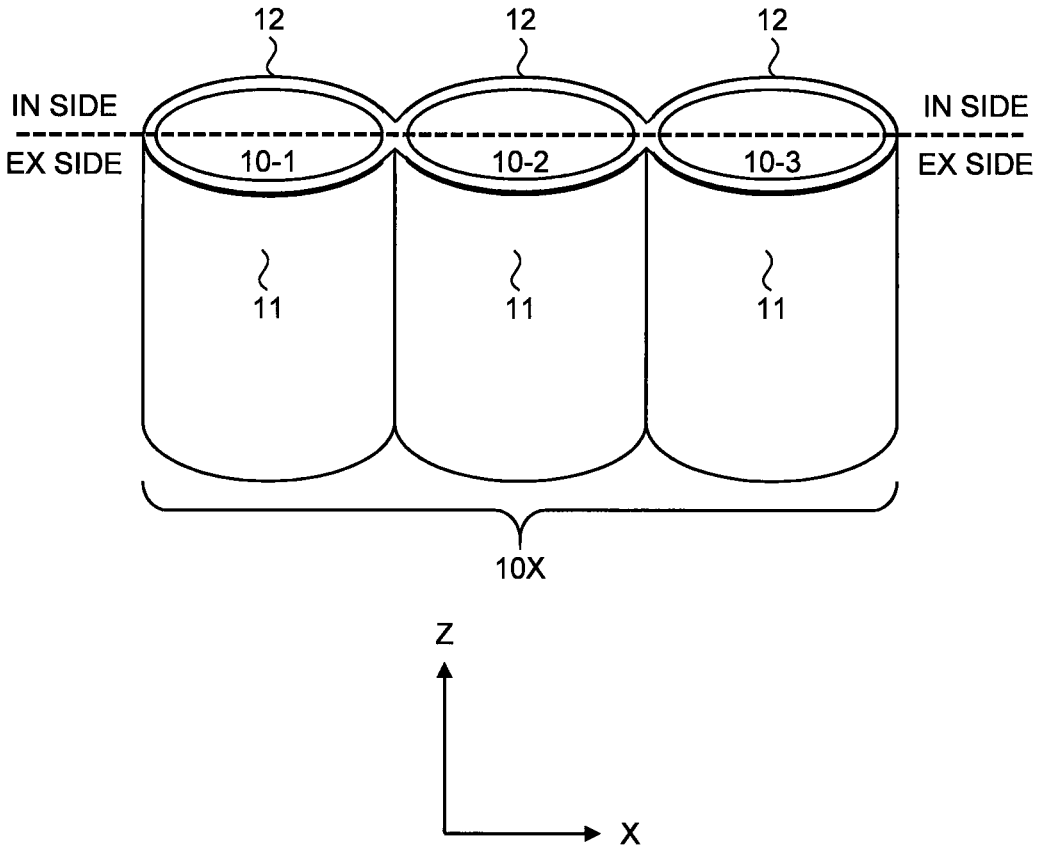
FIG. 3 is a schematic diagram for explaining a side wall of the cylinder structure according to the first embodiment of the present disclosure.

In order to explain a configuration of the cooling channel 100, let us first explain the side wall of the cylinder structure 10X with reference to FIG. 3. The side wall of the cylinder structure 10X includes a first side wall 11 and a second side wall 12. The first side wall 11 is the side wall on one of an intake side (i.e. a side of the intake port 50) and an exhaust side (i.e. a side of the exhaust port 60). The second side wall 12 is the side wall on the other of the intake side and the exhaust side. In the example shown in FIG. 3, the first side wall 11 is the side wall on the exhaust side, and the second side wall 12 is the side wall on the intake side.

Figure 4:
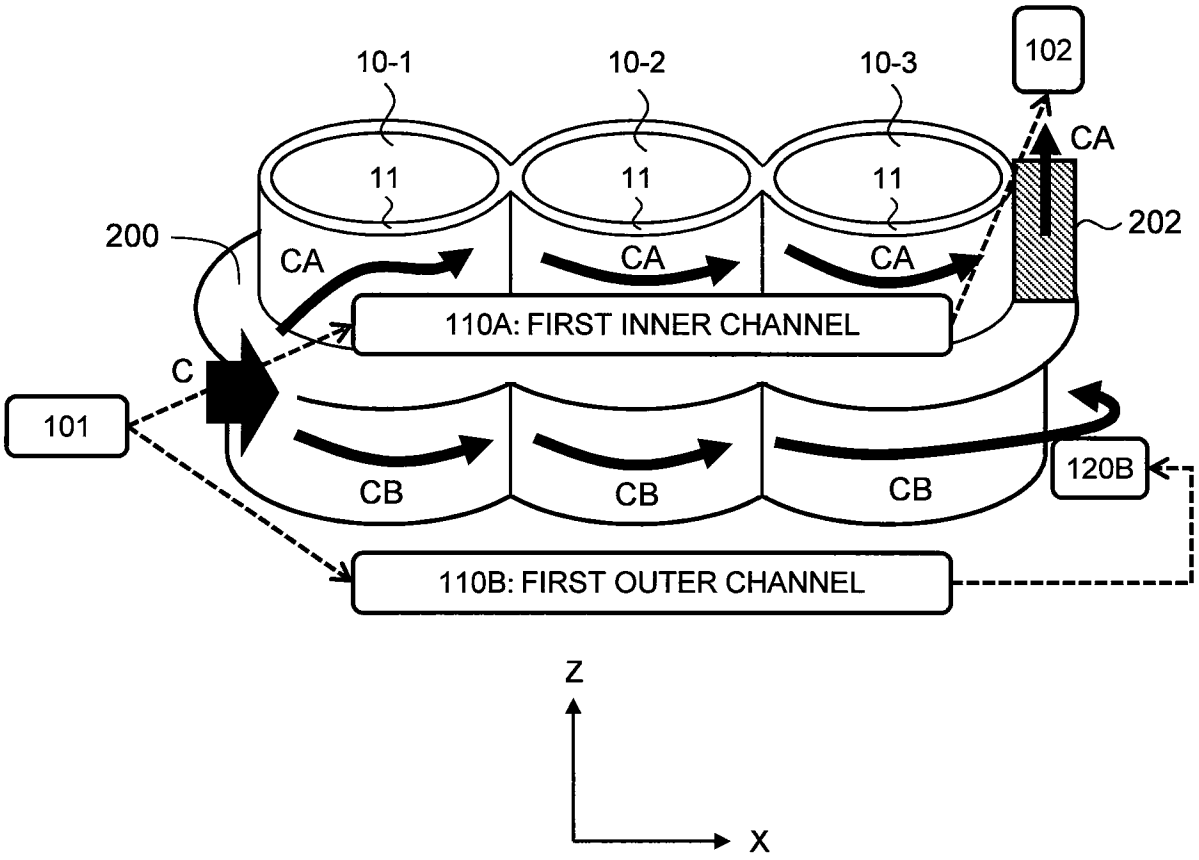
FIG. 4 is a schematic diagram for explaining a configuration of the cooling channel on a side of a first side wall of the cylinder structure according to the first embodiment of the present disclosure.
Figure 5:
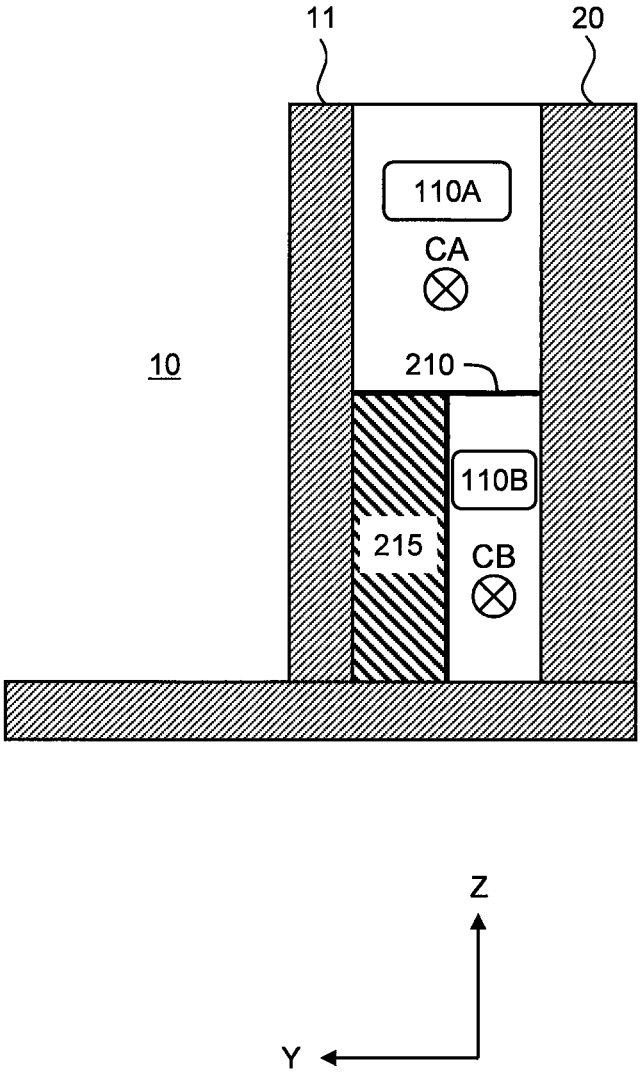
FIG. 5 is a cross-sectional diagram for explaining a configuration of the cooling channel on the side of the first side wall of the cylinder structure according to the first embodiment of the present disclosure.

FIGS. 4 and 5 are a schematic diagram and a cross-sectional diagram, respectively, for explaining a configuration of the cooling channel 100 on a side of the first side wall 11. The cooling channel 100 on the side of the first side wall 11 includes a "first inner channel 110A" and a "first outer channel 110B". Both of the first inner channel 110A and the first outer channel 110B face the first side wall 11.

The first inner channel 110A and the first outer channel 110B are separated in the Z-direction. More specifically, the first inner channel 110A is arranged on the upper side, and the first outer channel 110B is arranged on the lower side. For such the channel separation, the water jacket spacer 200 may include a first separating member 210 as shown in FIG. 5. The first separating member 210 is sandwiched between the first side wall 11 and the cylinder block 20, and separates the cooling channel 100 on the side of the first side wall 11 into the first inner channel 110A and the first outer channel 110B.

As shown in FIG. 5, the first outer channel 110B is away from the first side wall 11 than the first inner channel 110A is. Conversely, the first inner channel 110A is close to the first side wall 11 than the first outer channel 110B is. For example, the first inner channel 110A is in contact with the first side wall 11, whereas the first outer channel 110B is not in contact with the first side wall 11. For forming such the first outer channel 110B, the water jacket spacer 200 may include a first spacer member 215 as shown in FIG. 5. The first spacer member 215 is formed to be in contact with the first side wall 11. Due to the first spacer member 215, the first outer channel 110B is formed away from the first side wall 11.

The cooling channel 100 includes an inlet 101 to which the cooling medium C (e.g. cooling water) is injected (see FIG. 4). Respective upstream parts of the first inner channel 110A and the first outer channel 110B are connected to the inlet 101. The cooling medium C injected into the cooling channel 100 through the inlet 101 is distributed to the first inner channel 110A and the first outer channel 110B. The cooling medium C distributed to the first inner channel 110A is hereinafter referred to as a "first cooling medium CA". The cooling medium C distributed to the first outer channel 110B is hereinafter referred to as a "second cooling medium CB".

The first cooling medium CA flows through the first inner channel 110A. A direction from the upstream part towards a downstream part of the first inner channel 110A is a direction from the cylinder 10-1 towards the cylinder 10-3, and its principal component is the X-direction. In other words, the first inner channel 110A is arranged for the first cooling medium CA to flow along the plurality of cylinders 10-1, 10-2, and 10-3 in turn.

Moreover, the first inner channel 110A is arranged for the first cooling medium CA to be drained out of the cylinder block 20 without joining the second cooling medium CB. For example, as shown in FIG. 4, the downstream part of the first inner channel 110A is connected to an outlet 102. The outlet 102 is connected to the outside of the cylinder block 20, typically to the cylinder head 40. The water jacket spacer 200 may include a partition member 202 as shown in FIG. 4. The partition member 202 is located at the downstream part of the first inner channel 110A and prevents the first cooling medium CA from flowing into a side of the second side wall 12.

The cylinder structure 10X on the side of the first side wall 11 is effectively cooled by the first cooling medium CA flowing through the first inner channel 110A. Specifically, a temperature of an upper part of the cylinder structure 10X (cylinder 10) is high, and such the high-temperature part is effectively cooled by the first cooling medium CA. A temperature of the first cooling medium CA rises towards the downstream part of the first inner channel 110A. The first cooling medium CA whose cooling performance is decreased is drained out of the cylinder block 20 through the outlet 102 without joining the second cooling medium CB.

Meanwhile, the second cooling medium CB flows through the first outer channel 110B. A direction from the upstream part towards a downstream part of the first outer channel 110B is the direction from the cylinder 10-1 towards the cylinder 10-3, and its principal component is the X-direction. In other words, the first outer channel 110B is arranged for the second cooling medium CB to flow along the plurality of cylinders 10-1, 10-2, and 10-3 in turn.

It should be noted here that the first outer channel 110B is away from the first side wall 11 than the first inner channel 110A is (see FIG. 5). Although both the first cooling medium CA and the second cooling medium CB flow in the vicinity of the first side wall 11, a temperature of the second cooling medium CB does not rise as much as the first cooling medium CA. The temperature of the second cooling medium CB after flowing through the first outer channel 110B is lower than the temperature of the first cooling medium CA after flowing through the first inner channel 110A. That is, cooling performance of the second cooling medium CB is maintained without deterioration. Such the second cooling medium CB with high cooling performance is used for cooling the cylinder structure 10X on a side of the second side wall 12.

Figure 6:
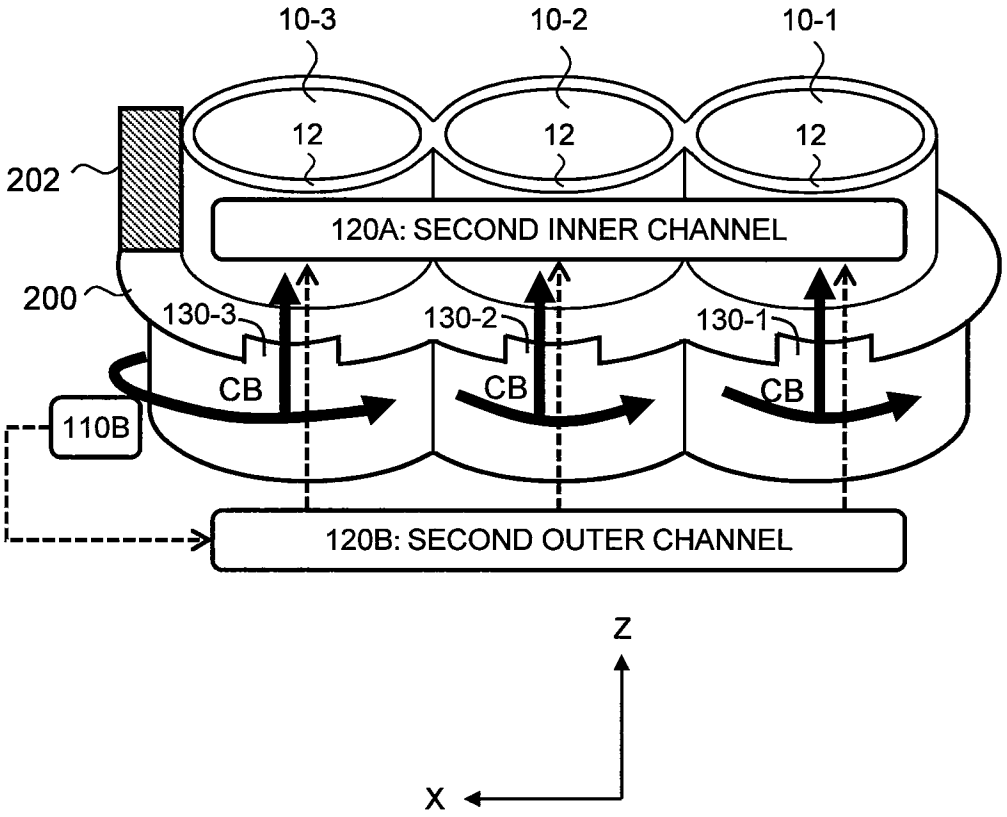
FIG. 6 is a schematic diagram for explaining a configuration of the cooling channel on a side of a second side wall of the cylinder structure according to the first embodiment of the present disclosure.
Figure 7:
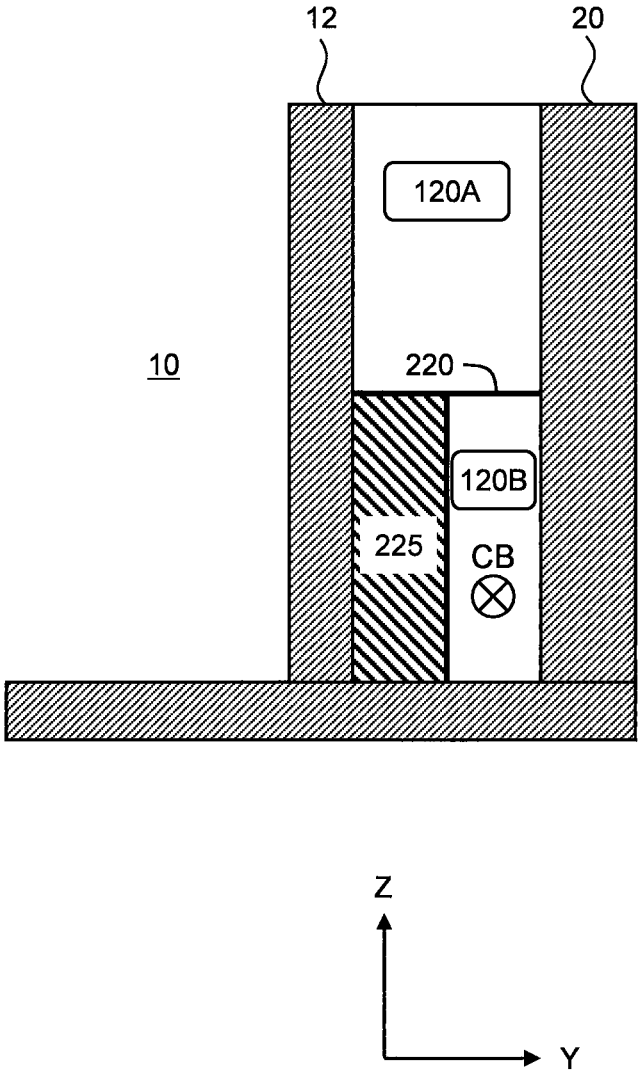
FIG. 7 is a cross-sectional diagram for explaining a configuration of the cooling channel on the side of the second side wall of the cylinder structure according to the first embodiment of the present disclosure.

FIGS. 6 and 7 are a schematic diagram and a cross-sectional diagram, respectively, for explaining a configuration of the cooling channel 100 on the side of the second side wall 12. The cooling channel 100 on the side of the second side wall 12 includes a "second inner channel 120A" and a "second outer channel 120B". Both of the second inner channel 120A and the second outer channel 120B face the second side wall 12.

The second inner channel 120A and the second outer channel 120B are separated in the Z-direction. More specifically, the second inner channel 120A is arranged on the upper side, and the second outer channel 120B is arranged on the lower side. For such the channel separation, the water jacket spacer 200 may include a second separating member 220 as shown in FIG. 7. The second separating member 220 is sandwiched between the second side wall 12 and the cylinder block 20, and separates the cooling channel 100 on the side of the second side wall 12 into the second inner channel 120A and the second outer channel 120B.

As shown in FIG. 7, the second outer channel 120B is away from the second side wall 12 than the second inner channel 120A is. Conversely, the second inner channel 120A is close to the second side wall 12 than the second outer channel 120B is. For example, the second inner channel 120A is in contact with the second side wall 12, whereas the second outer channel 120B is not in contact with the second side wall 12. For forming such the second outer channel 120B, the water jacket spacer 200 may include a second spacer member 225 as shown in FIG. 7. The second spacer member 225 is formed to be in contact with the second side wall 12. Due to the second spacer member 225, the second outer channel 120B is formed away from the second side wall 12.

As shown in FIG. 6, an upstream part of the second outer channel 120B is connected to the downstream part of the above-described first outer channel 110B. As a result, the above-described second cooling medium CB flows from the first outer channel 110B into the second outer channel 120B. A direction from the upstream part towards a downstream part of the second outer channel 120B is a direction from the cylinder 10-3 towards the cylinder 10-1, and its principal component is the −X-direction. In other words, the second outer channel 120B is arranged for the second cooling medium CB to flow along the plurality of cylinders 10-3, 10-2, and 10-1 in turn.

Figure 8:
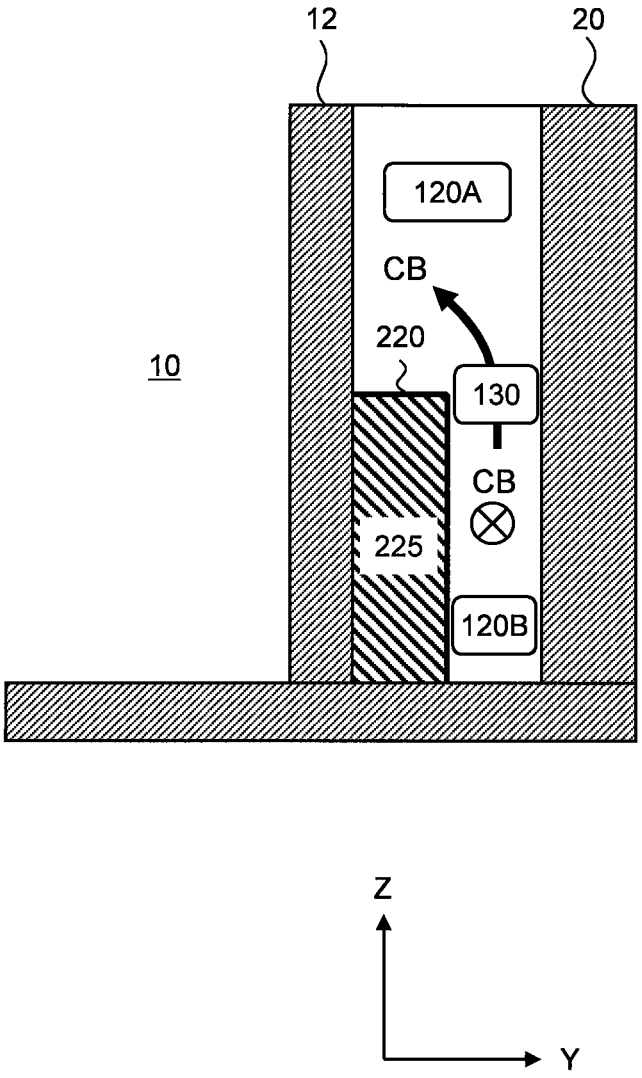
FIG. 8 is a cross-sectional diagram for explaining a configuration of the cooling channel on the side of the second side wall of the cylinder structure according to the first embodiment of the present disclosure.

The cooling channel 100 according to the present embodiment further includes a "connection channel 130" connecting between the second inner channel 120A and the second outer channel 120B. FIG. 8 is a cross-sectional diagram at a position of the connection channel 130. As shown in FIG. 8, the connection channel 130 is achieved, for example, by a through-hole penetrating through the second separating member 220. The second cooling medium CB in the second outer channel 120B is supplied to the second inner channel 120A through the connection channel 130.

As described above, the second outer channel 120B is away from the second side wall 12 than the second inner channel 120A is. Therefore, also in the second outer channel 120B, the temperature of the second cooling medium CB does not rise so much and the high cooling performance of the second cooling medium CB is maintained. Such the second cooling medium CB with the high cooling performance is supplied to the second inner channel 120A through the connection channel 130. Then, the cylinder structure 10X on the side of the second side wall 12 is effectively cooled by the second cooling medium CB with the high cooling performance. Specifically, the temperature of the upper part of the cylinder structure 10X (cylinder 10) is high, and such the high-temperature part is effectively cooled by the second cooling medium CB.

Furthermore, according to the present embodiment, a plurality of connection channels 130-*i* (i being an integer representing plural connection channels, such as connection channels 130-1, 130-2 and 130-3) are respectively provided at positions facing the plurality of cylinders 10-*i*, as shown in FIG. 6. Therefore, the second cooling medium CB is supplied in parallel through the plurality of connection channels 130-*i* to the second inner channel 120A at the positions facing the plurality of cylinders 10-*i*, respectively. It is thus possible to cool the plurality of cylinders 10-*i* more uniformly, as compared with a case where the second cooling medium CB flows along the plurality of cylinders 10-*i* in turn through the second inner channel 120A. As a result, variation in temperature between the plurality of cylinders 10-*i* is suppressed.

A cooling effect on the cylinder 10-*i* depends also on a flow rate of the second cooling medium CB passing through the connection channel 130-*i*. Therefore, it is possible to adjust the cooling effect on the cylinder 10-*i* by adjusting a cross-sectional area of the connection channel 130-*i*. Here, the cross-section of the connection channel 130-*i* is perpendicular to the direction of flow of the second cooling medium CB passing through the connection channel 130-*i*.

For example, a pressure of the second cooling medium CB in the second outer channel 120B decreases from the upstream part towards the downstream part. Therefore, the cross-sectional areas of the plurality of connection channels 130-*i* may be designed to increase from the upstream part towards the downstream part of the second outer channel 120B. As a result, respective flow rates of the second cooling media CB passing through the plurality of connection channels 130-*i* are equalized, and it is thus possible to further uniformly cool the plurality of cylinders 10-*i*.

The second cooling medium CB in the second inner channel 120A is appropriately drained out through an outlet not shown.

1-3. Summary

The cooling channel 100 facing the first side wall 11 of the cylinder structure 10X includes the first inner channel 110A and the first outer channel 110B. The cylinder structure 10X on the side of the first side wall 11 is effectively cooled by the first cooling medium CA flowing through the first inner channel 110A. Meanwhile, the cooling performance of the second cooling medium CB flowing through the first outer channel 110B is maintained without deterioration, because the first outer channel 110B is away from the first side wall 11 than the first inner channel 110A is.

The cooling channel 100 facing the second side wall 12 of the cylinder structure 10X includes the second inner channel 120A and the second outer channel 120B. The upstream part of the second outer channel 120B is connected to the downstream part of the first outer channel 110B. Accordingly, the second cooling medium CB with high cooling performance flows from the first outer channel 110B into the second outer channel 120B. Moreover, the second outer channel 120B is away from the second side wall 12 than the second inner channel 120A is. Therefore, the high cooling performance of the second cooling medium CB is maintained also in the second outer channel 120B.

The connection channel 130 connects between the second inner channel 120A and the second outer channel 120B. The second cooling medium CB in the second outer channel 120B is supplied to the second inner channel 120A through the connection channel 130. The cylinder structure 10X on the side of the second side wall 12 also is effectively cooled by the second cooling medium CB with the high cooling performance.

Furthermore, the plurality of connection channels 130-*i* are respectively provided at positions facing the plurality of cylinders 10-*i* of the cylinder structure 10X. Therefore, the second cooling medium CB is supplied in parallel through the plurality of connection channels 130-*i* to the second inner channel 120A at the positions facing the plurality of cylinders 10-*i*, respectively. It is thus possible to cool the plurality of cylinders 10-*i* more uniformly, as compared with a case where the second cooling medium CB flows along the plurality of cylinders 10-*i* in turn through the second inner channel 120A. As a result, variation in temperature between the plurality of cylinders 10-*i* is suppressed.

The cooling effect on the cylinder 10-*i* depends also on the flow rate of the second cooling medium CB passing through the connection channel 130-*i*. The pressure of the second cooling medium CB in the second outer channel 120B decreases from the upstream part towards the downstream part. Therefore, the cross-sectional areas of the plurality of connection channels 130-*i* may increase from the upstream part towards the downstream part of the second outer channel 120B. As a result, respective flow rates of the second cooling media CB passing through the plurality of connection channels 130-*i* are equalized, and it is thus possible to further uniformly cool the plurality of cylinders 10-*i*.

Moreover, the first inner channel 110A is arranged for the first cooling medium CA to be drained out of the cylinder block 20 without joining the second cooling medium CB. Since the first cooling medium CA whose cooling performance is lowered does not join the second cooling medium CB, decrease in cooling performance of the second cooling medium CB is suppressed.

2. Second Embodiment

Figure 9:
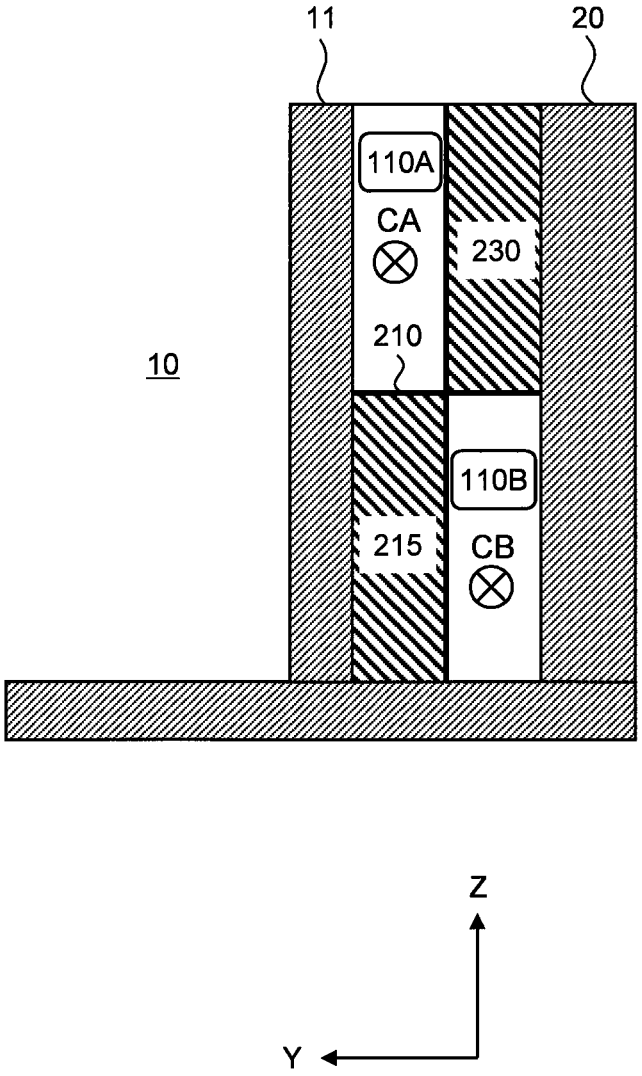
FIG. 9 is a cross-sectional diagram for explaining a configuration of the cooling channel according to a second embodiment of the present disclosure.

FIG. 9 is a cross-sectional diagram for explaining a configuration of the cooling channel 100 according to a second embodiment. In particular, FIG. 9 shows a cross-sectional configuration of the cooling channel 100 on the side of the first side wall 11, as in the case of FIG. 5 in the first embodiment. An overlapping description with the first embodiment will be omitted as appropriate.

According to the second embodiment, a cross-sectional area of the first inner channel 110A is smaller than that in the case of the first embodiment shown in FIG. 5. Here, the cross-section of the first inner channel 110A is perpendicular to the direction of flow of the first cooling medium CA. For example, the water jacket spacer 200 includes a narrowing member 230 as shown in FIG. 9. The cross-sectional area of the first inner channel 110A becomes smaller due to the narrowing member 230 arranged in the first inner channel 110A.

Since the cross-sectional area of the first inner channel 110A becomes smaller, a flow speed of the first cooling medium CA flowing through the first inner channel 110A increases, and thus cooling performance of the first cooling medium CA increases. As a result, it is possible to further effectively cool the cylinder structure 10X on the side of the first side wall 11.

The temperature of the first cooling medium CA rises from the upstream part towards the downstream part of the first inner channel 110A. In consideration of decrease in cooling performance due to the rise in temperature, the cross-sectional area of the first inner channel 110A may decrease from the upstream part towards the downstream part of the first inner channel 110A (This is equivalent to the narrowing member 230 becoming thicker from the upstream part towards the downstream part of the first inner channel 110A). In this case, the flow speed of the first cooling medium CA increases from the upstream part towards the downstream part of the first inner channel 110A. Increase in cooling performance due to the increase in flow speed compensates the decrease in cooling performance due to the rise in temperature. It is thus possible to more uniformly cool the plurality of cylinders 10-*i* also on the side of the first side wall 11. As a result, variation in temperature between the plurality of cylinders 10-*i* is suppressed.

3. Third Embodiment

Figure 10:
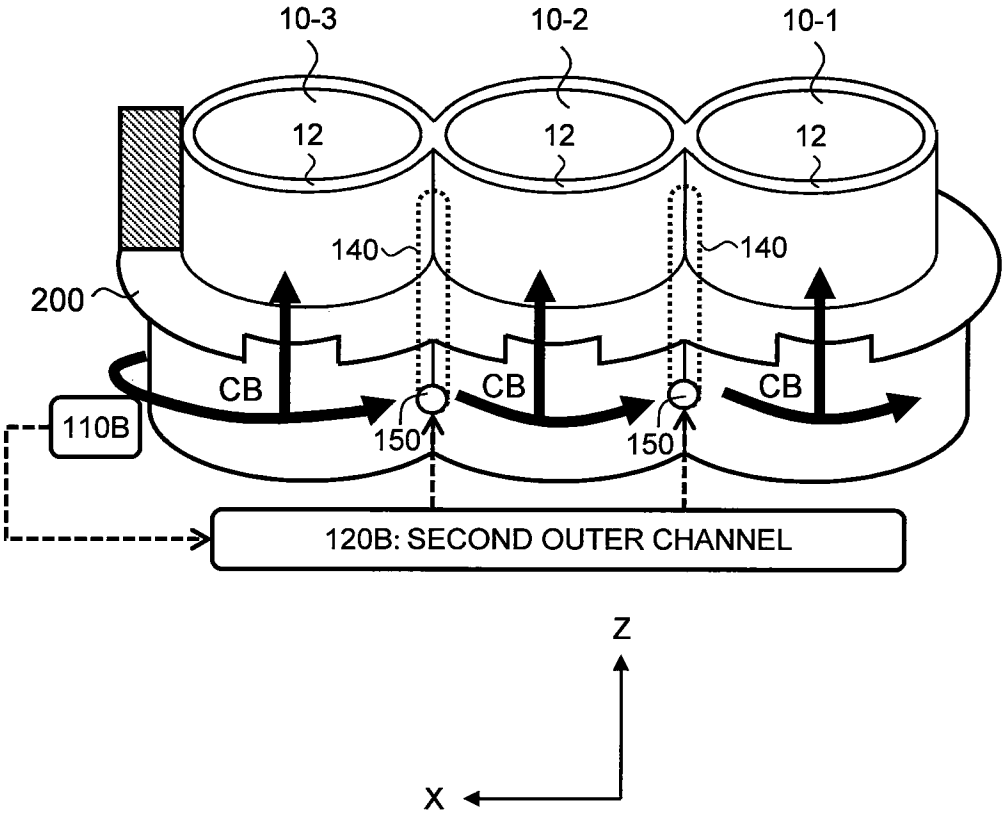
FIG. 10 is a schematic diagram for explaining a configuration of the cooling channel according to a third embodiment of the present disclosure.

FIG. 10 is a schematic diagram for explaining a configuration of the cooling channel 100 according to a third embodiment. In particular, FIG. 10 shows a configuration of the cooling channel 100 on the side of the second side wall 12, as in the case of FIG. 6 in the first embodiment. An overlapping description with the first embodiment will be omitted as appropriate.

As shown in FIG. 10, the cooling channel 100 further includes an inter-cylinder channel 140 (a drill path) arranged between adjacent cylinders 10. The inter-cylinder channel 140 is provided for cooling a part between the adjacent cylinders 10. The inter-cylinder channel 140 is connected to the second outer channel 120B through a connection hole 150. As a result, the second cooling medium CB with the high cooling performance is supplied from the second outer channel 120B to the inter-cylinder channel 140. The part between the adjacent cylinders 10 is effectively cooled by the second cooling medium CB with the high cooling performance.

It should be noted that it is also possible to combine the second embodiment and the third embodiment.

What is claimed is:

1. An internal combustion engine comprising:

a cylinder structure comprising a plurality of cylinders arranged inline; and a cooling channel arranged around a side wall of the cylinder structure, and through which a cooling medium flows, wherein the side wall of the cylinder structure comprises:

a first side wall on one of an intake side and an exhaust side; and a second side wall on another of the intake side and the exhaust side, and the cooling channel comprises:

an inlet to which the cooling medium is injected;

a first inner channel facing the first side wall, whose upstream part being connected to the inlet, and arranged for a first cooling medium of the injected cooling medium to flow through;

a first outer channel facing the first side wall, being away from the first side wall than the first inner channel is, whose upstream part being connected to the inlet, and arranged for a second cooling medium of the injected cooling medium to flow through, wherein a first separating member is provided at a location within the cooling channel so as to separate the cooling channel on a side of the first side wall into the first inner channel and the first outer channel;

a second outer channel facing the second side wall, whose upstream part being connected to a downstream part of the first outer channel, and arranged for the second cooling medium to flow through;

a second inner channel facing the second side wall, and being closer to the second side wall than the second outer channel is, wherein a second separating member is provided at a location within the cooling channel so as to separate the cooling channel on a side of the second side wall into the second out channel and the second inner channel; and a plurality of connection channels connecting between the second outer channel and the second inner channel, and respectively provided at positions facing the plurality of cylinders.

2. The internal combustion engine according to claim 1, wherein cross-sectional areas of the plurality of connection channels increase from the upstream part towards a downstream part of the second outer channel.

3. The internal combustion engine according to claim 1, wherein the cylinder structure and the cooling channel are arranged in a cylinder block, and the first inner channel is arranged for the first cooling medium to be drained out of the cylinder block without joining the second cooling medium.

4. The internal combustion engine according to claim 1, wherein a cross-sectional area of the first inner channel decreases from the upstream part towards a downstream part of the first inner channel.

5. The internal combustion engine according to claim 1, wherein the cooling channel further comprises an inter-cylinder channel arranged between adjacent cylinders of the plurality of cylinders, and the inter-cylinder channel is connected to the second outer channel.

6. The internal combustion engine according to claim 1, further comprising a partition member at a downstream part of the first inner channel, the partition member configured to prevent the first cooling medium from flowing into the side of the second side wall.

* * * * *